US012091808B2

(12) United States Patent
Park et al.

(10) Patent No.: US 12,091,808 B2
(45) **Date of Patent: *Sep. 17, 2024**

(54) LAUNDRY TREATING APPARATUS

(71) Applicant: LG ELECTRONICS INC., Seoul (KR)

(72) Inventors: Hye Yong Park, Changwon-si (KR); Hyung Gyu Lim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/549,339

(22) Filed: Aug. 23, 2019

(65) Prior Publication Data

US 2019/0376225 A1 Dec. 12, 2019

Related U.S. Application Data

(62) Division of application No. 13/513,769, filed as application No. PCT/KR2010/008930 on Dec. 14, 2010, now Pat. No. 10,400,384.

(30) Foreign Application Priority Data

Dec. 15, 2009 (KR) ..... 10-2009-0124596

(51) Int. Cl.

| | |
|---|---|
| ***D06F 58/10*** | (2006.01) |
| ***D06F 58/12*** | (2006.01) |
| ***D06F 58/20*** | (2006.01) |
| ***D06F 73/02*** | (2006.01) |

(52) U.S. Cl.

CPC ..... *D06F 58/10* (2013.01); *D06F 58/20* (2013.01); *D06F 58/203* (2013.01); *D06F 73/02* (2013.01); *D06F 58/12* (2013.01)

(58) Field of Classification Search

CPC ..... D06F 58/10; D06F 58/12; D06F 58/20; D06F 58/203; D06F 73/02

See application file for complete search history.

(56) References Cited

U.S. PATENT DOCUMENTS

| | | | | |
|---|---|---|---|---|
| 1,602,315 | A | 10/1926 | Wood | |
| 1,691,290 | A | 11/1928 | Judelson | |
| 2,324,710 | A | 7/1943 | Livar | 220/592.21 |
| 2,817,501 | A | 12/1957 | Schubert | 34/602 |

(Continued)

FOREIGN PATENT DOCUMENTS

| | | | |
|---|---|---|---|
| CN | 1548634 | A | 11/2004 |
| CN | 101824734 | A | 9/2010 |

(Continued)

OTHER PUBLICATIONS

Partial English Machine Translation KR-20080090743. Accessed Dec. 2014.*

(Continued)

*Primary Examiner* — Tavia Sullens

(74) *Attorney, Agent, or Firm* — Bryan Cave Leighton Paisner LLP

(57) ABSTRACT

The present invention relates to a laundry treating apparatus which can facilitate clothes drying, deodorizing, crumple-removing and sterilizing, thereby preventing the clothes from damage and providing them with improved thermal insulation.

28 Claims, 7 Drawing Sheets

(56) References Cited

U.S. PATENT DOCUMENTS

| | | | | | |
|---|---|---|---|---|---|
| 2,880,878 | A | | 4/1959 | Collette | A47F 3/08 211/1.56 |
| 3,027,653 | A | * | 4/1962 | Long | D06F 58/20 34/86 |
| 3,075,818 | A | | 1/1963 | Fay | A47B 47/03 312/265.4 |
| 3,653,532 | A | | 4/1972 | Mann | |
| 3,682,434 | A | | 8/1972 | Boenig | E04G 17/00 220/683 |
| 4,173,379 | A | | 11/1979 | van der Heiden | A47B 88/0014 312/348.1 |
| 4,295,693 | A | | 10/1981 | Viklund | A47B 47/03 312/263 |
| 4,682,424 | A | | 7/1987 | Irving | D06F 58/10 34/202 |
| 5,305,484 | A | * | 4/1994 | Fitzpatrick | D06F 73/02 223/70 |
| 5,505,230 | A | | 4/1996 | Bartholomew | H02G 3/0481 138/164 |
| 5,794,818 | A | | 8/1998 | Bromwell | B65D 11/10 220/684 |
| 7,137,211 | B2 | | 11/2006 | Johnson | D06F 58/10 34/401 |
| 8,296,967 | B2 | | 10/2012 | Kim | D06F 58/20 34/201 |
| 10,400,384 | B2 | | 9/2019 | Park et al. | |
| 2003/0223309 | A1 | | 12/2003 | Hapke | |
| 2004/0244439 | A1 | | 12/2004 | Hee Han | D06F 39/12 68/23 R |
| 2006/0037209 | A1 | | 2/2006 | Johnson et al. | |
| 2006/0255700 | A1 | | 11/2006 | Park | D06F 39/12 312/228 |
| 2008/0022551 | A1 | | 1/2008 | Banta et al. | |
| 2009/0066205 | A1 | | 3/2009 | Park | D06F 39/12 312/228 |
| 2009/0113944 | A1 | | 5/2009 | Kim | D06F 17/00 68/5 C |
| 2009/0235555 | A1 | | 9/2009 | Jie Bo | |
| 2010/0043500 | A1 | | 2/2010 | Yoo | D06F 58/10 68/5 C |
| 2010/0146805 | A1 | | 6/2010 | Kim et al. | |

FOREIGN PATENT DOCUMENTS

| | | | | | |
|---|---|---|---|---|---|
| EP | 1876283 | A1 | | 1/2008 | |
| FR | 1270366 | A | | 8/1961 | B65D 90/08 |
| GB | 617965 | A | * | 2/1949 | F26B 9/06 |
| GB | 2433109 | A | | 6/2007 | |
| JP | 9140999 | A | | 6/1997 | |
| JP | 2000225298 | A | | 8/2000 | |
| JP | 2006-130157 | A | | 5/2006 | |
| KR | 10-0524400 | B1 | | 10/2005 | |
| KR | 10-2007-0109319 | | | 11/2007 | |
| KR | 10-2008-0004028 | | | 1/2008 | |
| KR | 2008/0090743 | A | | 10/2008 | |
| KR | 20080090743 | | * | 10/2008 | D06F 58/20 |
| KR | 10-2010-0094796 | | | 8/2010 | |
| WO | 2011126318 | A2 | | 10/2011 | |

OTHER PUBLICATIONS

KR 20080090743: English Machine Translation. Accessed Dec. 20, 2014.

* cited by examiner

【Figure 1】
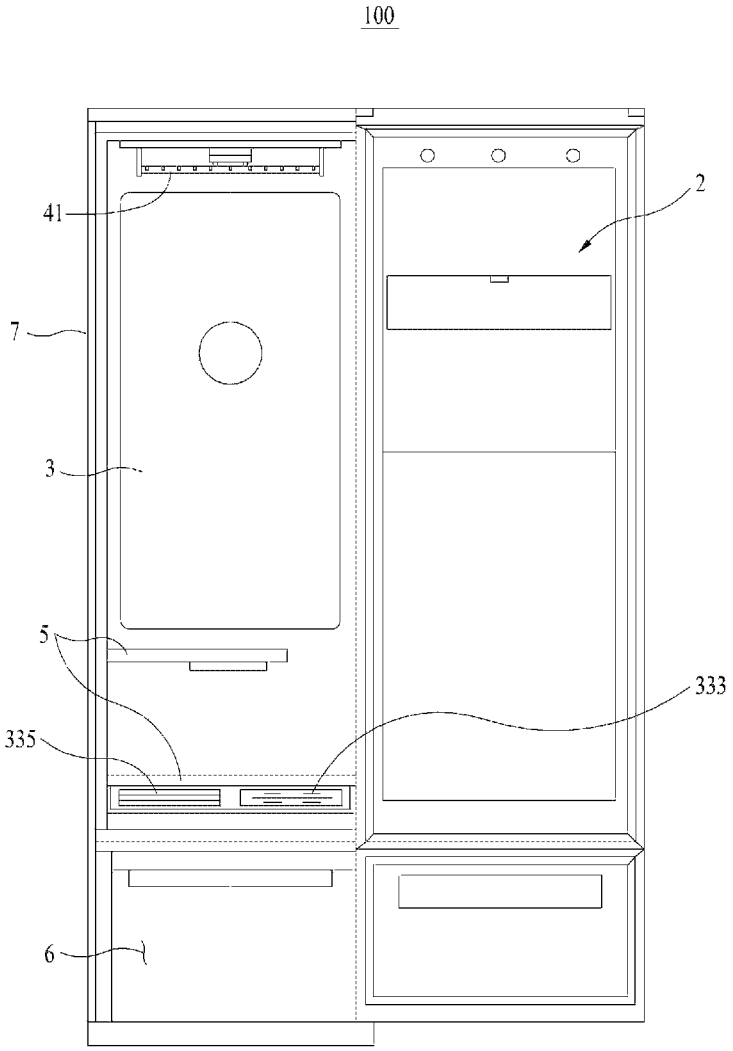

【Figure 2】
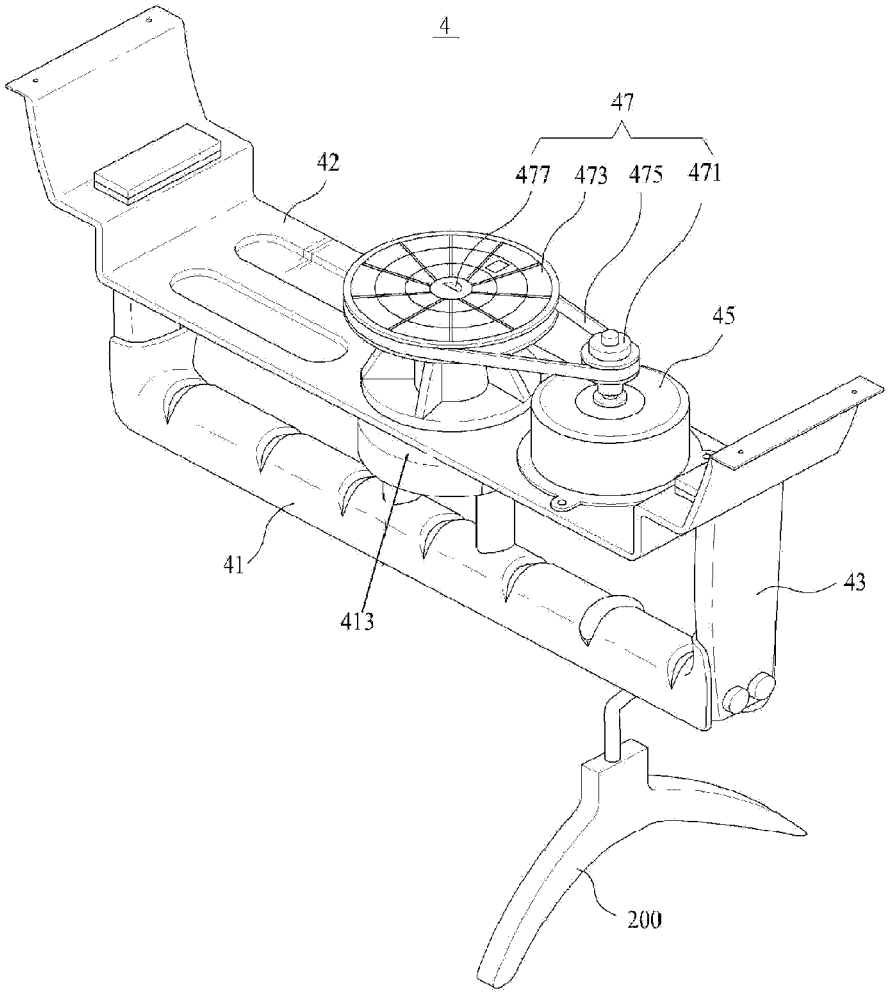

【Figure 3】
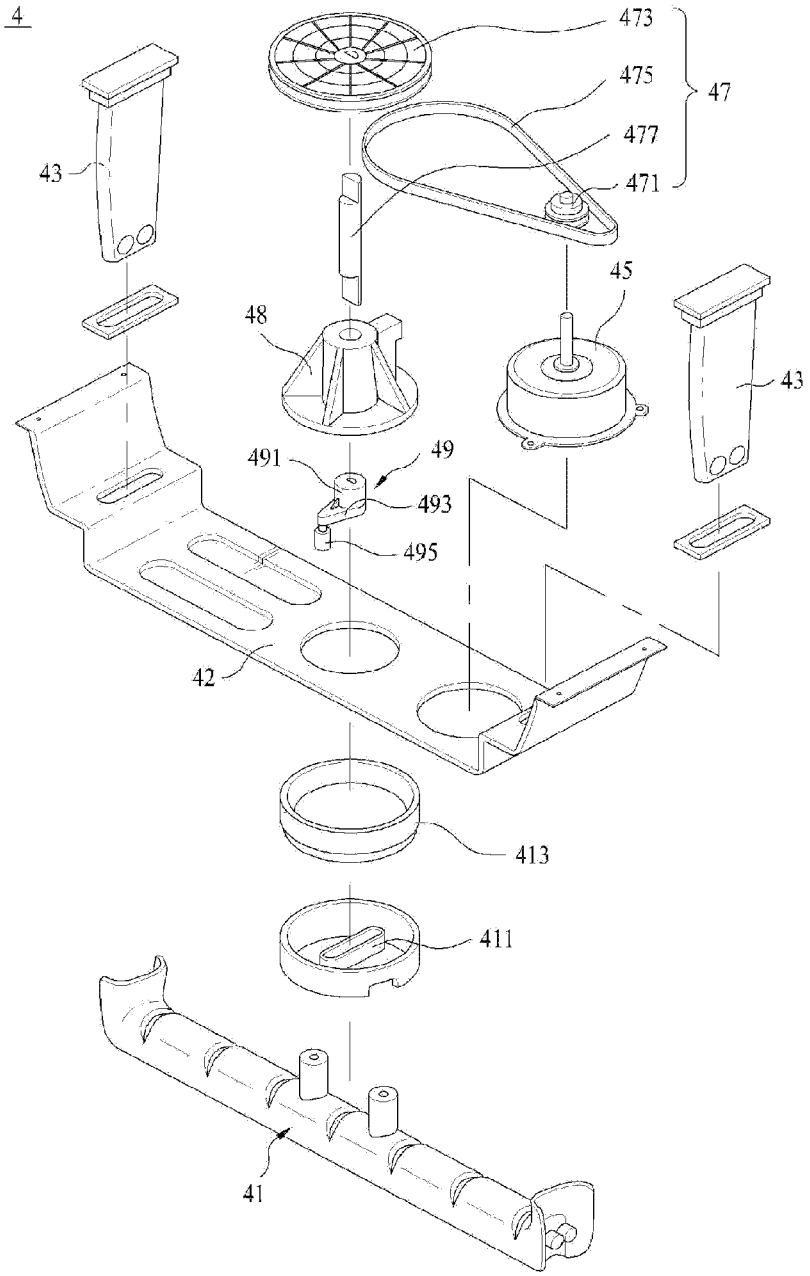

【Figure 4】
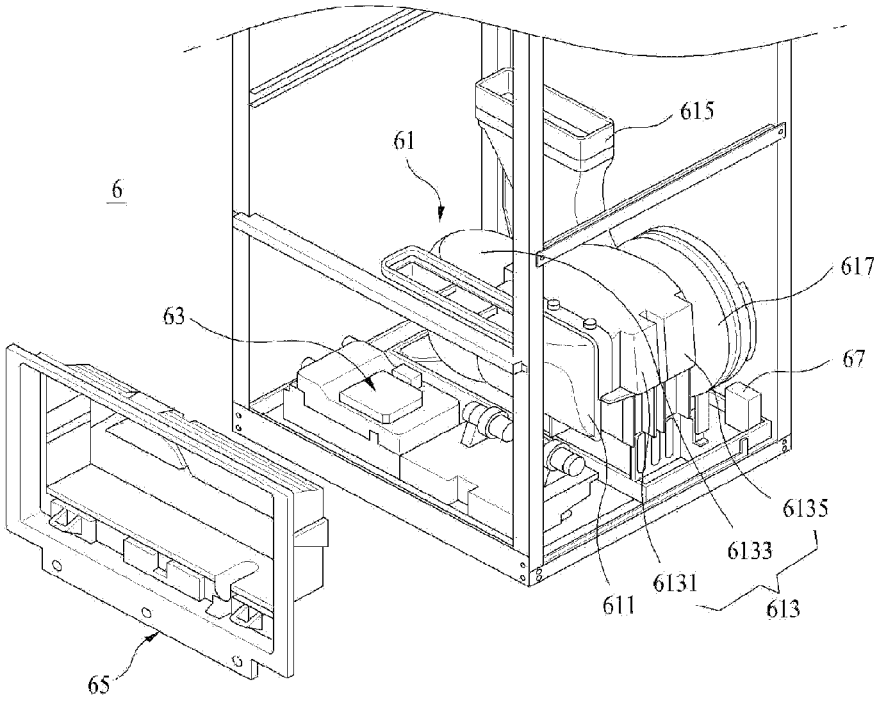

【Figure 5】
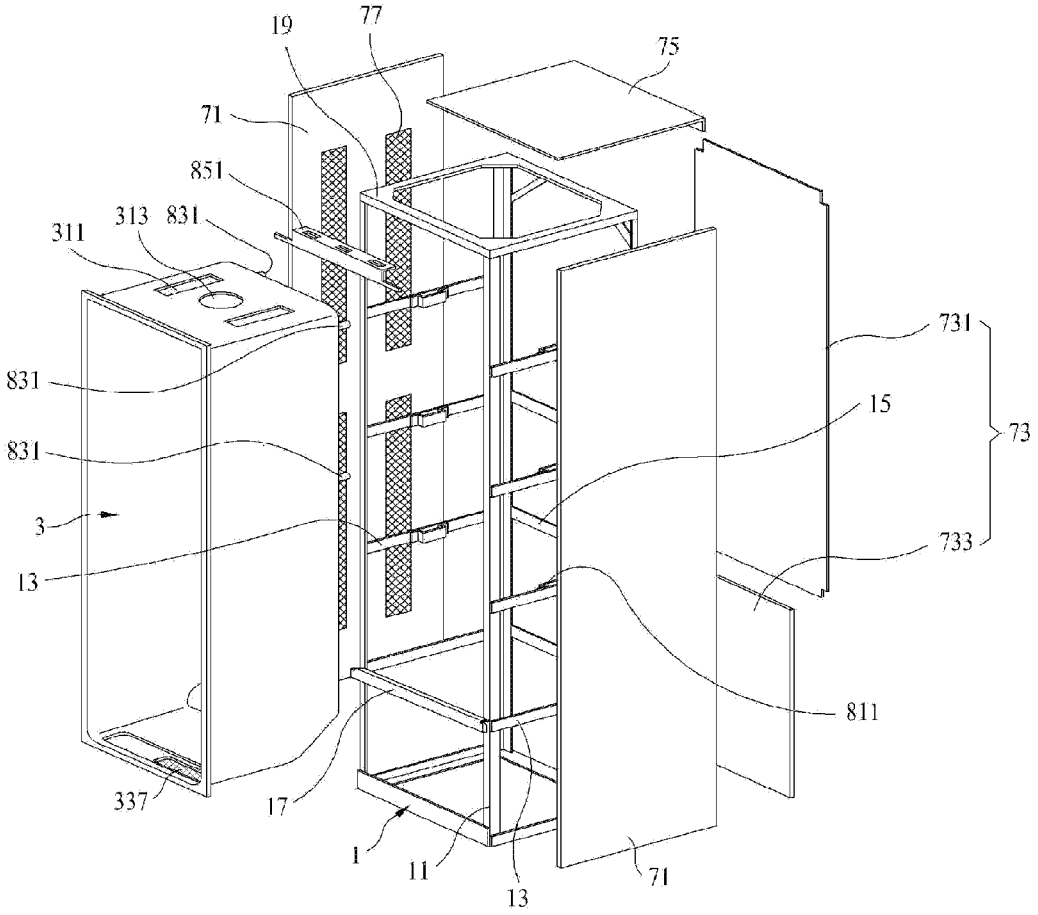

【Figure 6】
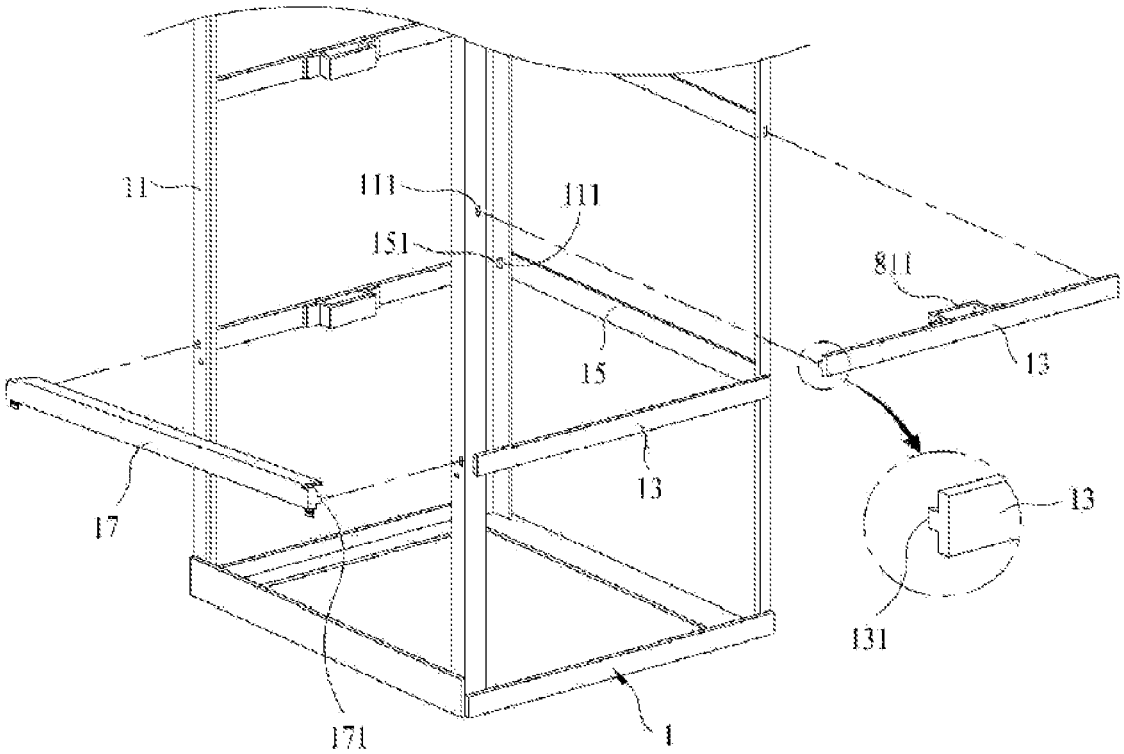

【Figure 7】
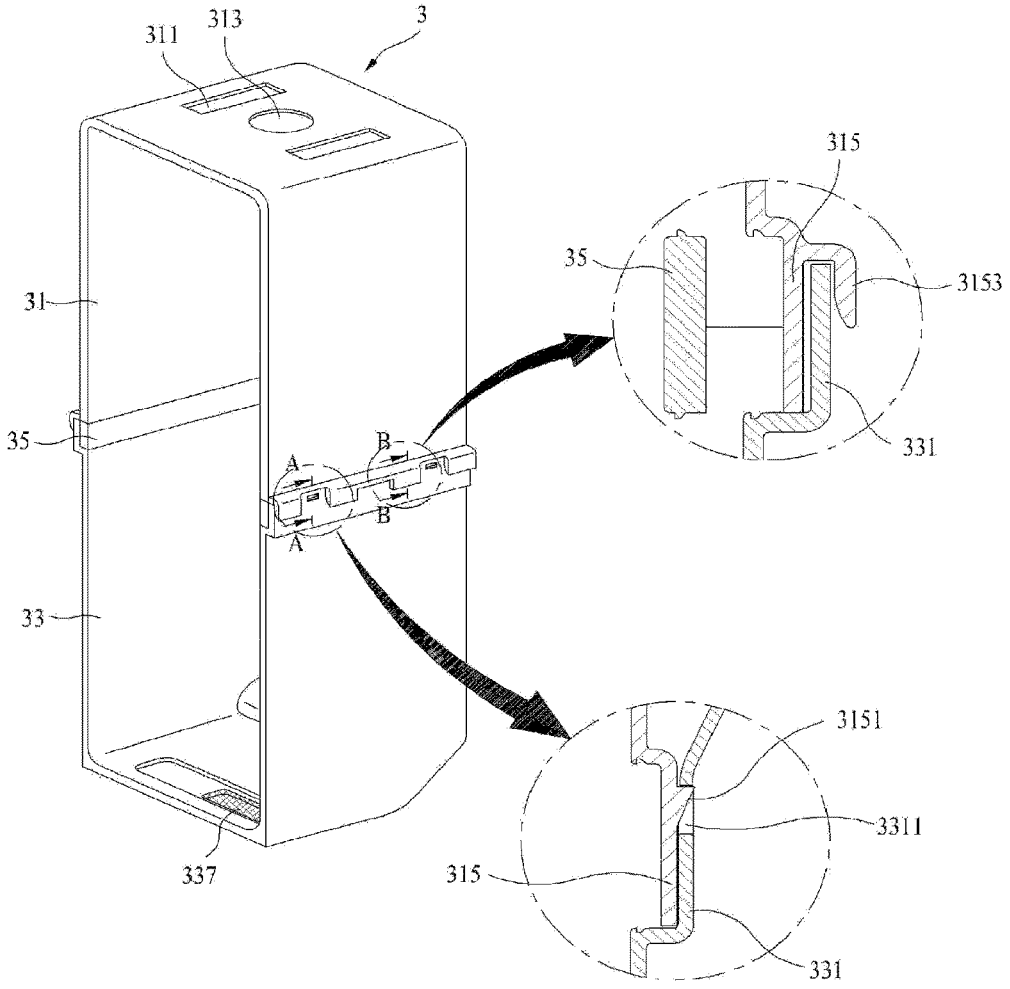

LAUNDRY TREATING APPARATUS

This application is a divisional of application Ser. No. 13/513,769, filed on Jun. 4, 2012, now allowed, which is a National Stage Application of International Application No. PCT/KR2010/008930, filed Dec. 14, 2010, and claims the benefit of Korean Application No. 10-2009-0124596, filed on Dec. 15, 2009, each of which is hereby incorporated by reference for all purposes as if fully set forth herein.

TECHNICAL FIELD

The present invention relates to a laundry treating apparatus which can facilitate clothes drying, deodorizing, crumple-removing and sterilizing.

BACKGROUND ART

In general, the laundry treating apparatus, being an apparatus for performing various functions required for management of the clothes, is a concept including washing machines for washing the clothes, dryers for drying wet clothes, and refreshers for removal of odor and crumples from the clothes.

It is a recent trend that the laundry treating apparatus is developed to solve the troubles of the clothes washing, drying, deodorizing, and crumple removal with one apparatus. However, since a recent laundry treating apparatus uses a drum for holding the clothes therein and a driving unit for rotating the drum, the laundry treating apparatus has been somewhat inadequate for deodorizing and removal of crumples from the clothes.

That is, in general, since a related art laundry treating apparatus progresses the deodorizing and removal of crumples while the drum is rotated, and the clothes in the drum is not in a spread state, but in a crumpled state, the laundry treating apparatus has a limitation in the deodorizing and the removal of crumples.

Moreover, since the related art laundry treating apparatus transmits heat to the clothes directly from a heater therein, the laundry treating apparatus is liable to cause damage to the clothes.

Furthermore, the related art laundry treating apparatus has difficulty for thermally insulating an inside from an outside of the laundry treating apparatus, the related art laundry treating apparatus is liable to make a performance thereof poor.

DISCLOSURE

Technical Problem

To solve the problems, an object of the present invention is to provide a laundry treating apparatus which can facilitate clothes drying, deodorizing, crumple-removing and sterilizing.

Another object of the present invention is to provide a laundry treating apparatus which can prevent clothes from damaging and reduce power consumption.

Another object of the present invention is to provide a laundry treating apparatus which can improve thermal insulation for improving clothes drying, deodorizing, crumple-removing and sterilizing performances.

Technical Solution

To achieve these objects and other advantages and in accordance with the purpose of the invention, as embodied and broadly described herein, a laundry treating apparatus includes an outer cabinet which forms an exterior of the laundry treating apparatus, an inner cabinet provided in the outer cabinet for providing a space for holding clothes, a frame for supporting an outside circumferential surface of the inner cabinet and fixedly securing the outer cabinet thereto, a supply unit portion for supplying hot air or steam to an inside of the inner cabinet, selectively, and an air gap forming portion for forming an air gap between the inner cabinet and the outer cabinet.

In this case, the air gap forming portion can include side air gaps for spacing a predetermined distance between an outside circumferential surface of the inner cabinet and the outer cabinet.

And, the air gap forming portion can include a rear side air gaps for spacing a predetermined distance between a rear side of the inner cabinet and the outer cabinet.

And, the air gap forming portion can include a top side air gap for spacing a predetermined distance between a top side of the inner cabinet and the outer cabinet.

And, the frame can include a body frame provided in a height direction of the inner cabinet, side frames provided both side direction of the inner cabinet to connect the body frames, and a rear side frame provided to a rear side direction of the inner cabinet to connect the body frames.

In this case, the air gap forming portion is air gap frames projected from the side frames to an outside circumferential direction of the inner cabinet, respectively.

And, the air gap forming portion further includes an air gap boss provided projected from a rear side of the inner cabinet and supported on the rear side frame.

And, the laundry treating apparatus can further include a top frame provided to a top side of the body frame, and the air gap forming portion can further include an air gap bracket provided to the top side of top frame and the inner cabinet.

And, one of the body frame and the side frame includes a preliminary fastening hole, and the other one can further include a preliminary fastening projection for being received in the preliminary fastening hole.

And, one of the body frame and the rear side frame includes a preliminary fastening hole, and the other one can further include a preliminary fastening projection for being received in the preliminary fastening hole.

In the meantime, the laundry treating apparatus further includes a front frame for separating the supply unit portion from the inner cabinet, and the front frame can be provided to support a lower side of the inner cabinet.

In this instance, one of the body frame and the front frame includes a preliminary fastening hole, and the other one can further include a preliminary fastening projection for being received in the preliminary fastening hole.

In the meantime, the inner cabinet is provided divided into an upper body and a lower body, wherein the upper body includes an upper rib provided extended toward the lower body and the lower body can include a lower body provided to be in contact with the upper rib.

In this case, the upper rib can further include a rib receiving portion for receiving the lower rib.

And, the laundry treating apparatus can further includes a cover portion for covering a coupling surface of the upper body and the lower body and preventing hot air or steam from leaking.

And, the cover portion is detachable from the upper rib or the lower rib.

In the meantime, the laundry treating apparatus can further includes a strength reinforcing portion for reinforcing strength of the outer cabinet.

In this case, the strength reinforcing portion is a damping sheet provided to the outer cabinet.

Advantageous Effects

The present invention can provide a laundry treating apparatus which can facilitate clothes drying, deodorizing, crumple-removing and sterilizing.

And, the present invention can provide a laundry treating apparatus which can prevent the clothes from damaging and reduce power consumption.

And, the present invention can provide a laundry treating apparatus having an improved thermal insulation.

DESCRIPTION OF DRAWINGS

FIG. 1 illustrates a front view of a laundry treating apparatus.

FIG. 2 illustrates an assembled perspective view of a moving hanger.

FIG. 3 illustrates an exploded perspective view of a moving hanger.

FIG. 4 illustrates a schematic view of a supply unit portion.

FIG. 5 illustrates an exploded perspective view of a laundry treating apparatus.

FIG. 6 illustrates an exploded perspective view of a frame.

FIG. 7 illustrates a perspective view of an inner cabinet.

BEST MODE

Reference will now be made in detail to the specific embodiments of the present invention, examples of which are illustrated in the accompanying drawings.

As far as there is no particular definition, all terms in the specification are the same with a general meaning of the term understood by persons skilled in this field of art, and, if the term used in the specification conflicts with the general meaning of the term, the meaning of the term used in the specification prevails.

In the meantime, a configuration or a control method of a device described hereinafter is provided only for describing embodiments of the present invention, but not for limiting scope of patent rights of the present invention. Wherever possible, the same reference numbers will be used throughout the drawings to refer to the same or like parts.

A preferred embodiment of the present invention will be described with reference to the attached drawing in detail.

FIG. 1 illustrates a front view of a laundry treating apparatus in accordance with a preferred embodiment of the present invention, with doors thereof opened.

Though the specification describes a laundry treating apparatus taking a refresher which refreshes clothes and supplies hot air as an example, the present invention is not limited to this, but aspects of the present invention are applicable to other apparatuses provided with a heat pump for treating clothes described later, too.

The term of 'refresh' used in the specification means a process of supplying air, heated air, water, mist, steam, or so on to clothes for removing wrinkles, deodorizing, sanitizing, preventing static electricity and warming of the clothes.

Moreover, the clothes mentioned in the specification includes all objects that can be washed, including, not only the clothes and the apparel, but also objects that people can wear, such as shoes, socks and stockings, gloves, headgears, mufflers, and so on, as well as objects people use, such as dolls, towels, blankets, and so on.

Referring to FIG. 1, the laundry treating apparatus 100 includes a frame 1 (See FIG. 5) which is a frame thereof, an outer cabinet 7 provided to an outside of the frame to form an exterior of the laundry treating apparatus, an inner cabinet 3 provided to a space the frame and the outer cabinet form for providing a space for holding the clothes, doors 2 for opening/closing the inner cabinet 3, supporters comprising hanger bar 41 and shelves 5 for placing the clothes in the inner cabinet, a supply unit portion 6 having an air supply portion 61 (See FIG. 4) for supplying air or hot air to the inner cabinet 3 and a steam generator 63 (See FIG. 4) for supplying steam, water or mist to the inner cabinet 3 provided thereto, and a control unit (not shown) for controlling various units in the supply unit portion.

It is preferable that the inner cabinet 3 has a first inlet 335 and a filter unit 337 (See FIG. 5) in communication with the air supply portion 61 (See FIG. 4) and a second inlet 333 in communication with the steam generator 63.

The supporters can be fixedly secured to the inner cabinet such that the clothes can be refreshed by the hot air or steam being supplied from the air supply portion or the steam generator while the clothes is stationary.

That is, the supporters can be shelves 5 fixedly secured to an inner circumference of the inner cabinet and a hanger bar 41 fixedly secured to an upper portion of the inner cabinet. In this case, it is preferable that each of the shelves 5 has a frame shape having opened upper and lower faces for allowing the hot air or the steam from the supply unit portion 6 described later to pass therethrough, for easy supply of the hot air or steam to the clothes on the shelves.

Accordingly, since the clothes introduced to the laundry treating apparatus of the present invention is not in an entangled state like the clothes introduced to the related art drum type laundry treating apparatus, the laundry treating apparatus of the present invention can expect excellent effects, not only in deodorizing and crumple removal, but also in drying of the clothes.

However, the hanger bar 41 at the upper portion of the inner cabinet 3 can be a moving hanger which can shakes the clothes in a horizontal direction (in left/right directions or front/rear directions). In this case, since the moving hanger makes the clothes not to entangle with one another even if the moving hanger shakes the clothes while the hot air or the steam is supplied to the inner cabinet 3, the moving hanger can improve the clothes drying, deodorizing, crumple removal, and sterilization efficiency, further.

That is, an increased clothes refresh performance can be expected.

FIG. 2 illustrates an assembled perspective view of the moving hanger, and FIG. 3 illustrates an exploded perspective view of the moving hanger. The moving hanger will be described with reference to FIGS. 2 and 3.

The moving hanger 4 includes a hanger bar 41 for hanging a clothes hanger 200 therefrom having the clothes placed thereon, and a holder 43 for holding both ends of the hanger bar 41. The holder 43 can be provided to the upper portion of the inner cabinet 3, and the hanger bar 41 can have both ends thereof connected to the holder 43.

Accordingly, since the laundry treating apparatus of the present invention has the clothes introduced thereto placed on the clothes hanger, not only an excellent refreshing effect, but also an excellent drying effects can be expected in comparison to the related art laundry treating apparatus.

In the meantime, the moving hanger 4 includes a motor 45, a power converting portion 49 for converting a rotation motion from the motor 45 into a linear horizontal motion of the hanger bar 41, a power transmission portion 47 for transmission of power from the motor 45 to the power converting portion 49, and a frame 42 provided to an outside circumference of an upper end of the inner cabinet for holding above elements.

The power transmission portion 47 can be provided to include a drive pulley 471 provided to the motor 45, a driven pulley 473 connected to the drive pulley with a belt 475, a rotation shaft 477 coupled to a center of the driven pulley. It is preferable that the clothes hanger bar 41 is provided to include a slot 411 perpendicular to a length direction thereof. And, the power converting portion 49 can be provided to include a slot inserting portion 495 to be inserted in the slot 411, a shaft coupling portion 491 to be coupled to the rotation shaft 477, and a rotation arm 493 connected between the slot inserting portion and the shaft coupling portion.

In this case, a bearing housing 48 can be provided between the shaft coupling portion 491 and the driven pulley 473 for supporting rotation of the rotation shaft further, and a converting portion cover 413 can be included further for preventing the power converting portion from being exposed to an outside in view of sense of beauty.

In above configuration, since the driven pulley 473 rotates if the motor 45 rotates, the rotation of the rotation shaft 477 coupled to the driven pulley will cause the slot inserting portion 495 to make a circular motion to have a predetermined diameter (a length of the rotation arm 493).

In the meantime, the slot 411 in the hanger bar 41 is perpendicular to the length direction of the hanger bar and has a length greater than a diameter of a rotation locus of the slot inserting portion 495. Accordingly, the slot 411 will make a linear motion in a horizontal direction even if the slot inserting portion 495 makes a circular motion.

Therefore, the hanger bar 41 coupled to the slot 411 makes a linear motion in a length direction of the hanger bar. However, if the slot 411 is parallel to the length direction of the hanger bar 41, the hanger bar will make a linear motion in a direction perpendicular to the length direction of the hanger bar.

FIG. 4 illustrates a perspective view of the supply unit portion 6, schematically. For convenience's sake, FIG. 4 illustrates major elements including the air supply portion 61 and the steam generator 63 only, but not pipelines which connect above elements.

The supply unit portion 6 has the air supply portion 61 positioned therein for supplying air or hot air to the inner cabinet 3, and the steam generator 63 for supplying water, mist or steam (hereafter steam) to the inner cabinet, and is preferably provided at a lower portion of the inner cabinet.

The supply unit portion 6 is positioned at the lower portion of the inner cabinet 3 since the hot air, heated steam, and the like being supplied to the inner cabinet has a nature of tending to rise.

That is, once the supply unit portion 6 is provided to supply the hot air of the steam to the lower portion of the inner cabinet 3, the steam or the hot air can be supplied to the inner cabinet uniformly without any separate circulating unit.

Referring to FIG. 4, the supply unit portion 6 has the air supply portion 61 positioned therein for supplying air or the hot air to the inner cabinet 3.

The air supply portion 61 of the present invention includes an inlet 611 connected to the filter unit 337 (See FIG. 5) provided to the inner cabinet 3, an outlet 615 connected to the first inlet 335 of the inner cabinet 3, and a heat exchanger unit 613 provided between the inlet and the outlet.

The heat exchanger unit 613 can be a heat pump, and the heat pump is provided with an evaporator 6131, a compressor 6133, a condenser 6135, and an expansion valve (not shown), through which refrigerant circulates, for dehumidifying and heating the air.

That is, since the evaporator 6131 absorbs latent heat from surrounding air as the refrigerant evaporates therein, the evaporator 6131 removes water from the air in contact with the evaporator, and since the condenser 6135 discharges heat generated in a course of condensing of the refrigerant, the condenser 6135 heats the air in contact with the condenser 6135. Therefore, the air introduced to the air supply portion 61 is supplied to the inner cabinet 3 after dehumidified and heated through the evaporator 6131 and the condenser 6135.

Though the air heated by the heat pump thus can have a temperature more or less lower than the air heated by a related art electric heater, the air can be dehumidified without using a separate dehumidifier.

Therefore, the air supplied to a holding space by the heat pump is relatively 'low temperature air' (In this instance, the 'low temperature' means a temperature that is not low absolutely, but a temperature relatively low in comparison to related art heated air though the air is heated air). The clothes treating apparatus in accordance with a preferred embodiment of the present invention can prevent the clothes from deforming or damaging due to a high temperature in a case the clothes treating apparatus of the present invention performs a process for refreshing or drying the clothes by supplying the low temperature dry air to the clothes.

At the end, the air supplied by the heat pump in the clothes treating apparatus in accordance with a preferred embodiment of the present invention can make easy drying and refreshing of the clothes since the heat pump supplies dehumidified air without a dehumidifier even though the air has a temperature lower than the hot air from the related art clothes treating apparatus.

The inlet 611 has the filter unit 337 (See FIG. 5) positioned thereon for filtering air being introduced to the air supply portion 61 from the inner cabinet 3 for removing foreign matters possibly contained in the air to supply only clean air to the inner cabinet.

In the meantime, the filter unit is provided to a bottom of the inner cabinet for easy cleaning of the filter unit 337.

The outlet 615 can further include a discharge fan 617 connected to the first inlet 335 of the inner cabinet for making an easy air flow in making the hot air heated by heat exchange to flow to the inner cabinet.

In the meantime, the supply unit portion 6 can include the steam generator 63 for supplying steam (water, mist, steam, etc.) to the inner cabinet 3, selectively.

The steam generator 63 can be provided to include a water storage unit (not shown) storage of water and a heater (not shown) for heating the stored water to generate the steam or can be provided to include vibration means (not shown, ultrasonic vibration means, and the like) to provide vibration energy to the water stored in the water storage for generating mist.

As a water supply source for supplying the water to the steam generator 63, an external utility water tap can be used, or a container type water supply source provided to one side of the supply unit portion 6 can be used.

Preferably, the container type water supply source can be provided to a supply unit portion door 65 detachably mounted to one side of the supply unit portion 6, and the water supply source can be mounted to the supply unit portion door 65, detachably. Accordingly, the user can dismount the water supply source from the supply unit portion 6, fill the water storage unit with water, and mount the water supply source to the supply unit portion door 65, again.

And, the steam generated at the steam generator 63 is supplied to the inner cabinet through the spray nozzle (not shown) provided to the second inlet 333 in the inner cabinet. The steam generator 63 and the spray nozzle (not shown) are connected with a pipe (not shown).

The supply unit portion 6 can have a cooling fan 67 mounted to a rear side thereof. The cooling fan 67 draws air from an outside of the supply unit portion 6 into the supply unit portion 6 for preventing an inside temperature of the supply unit portion 6 from rising excessively by the air supply portion 61 and the steam generator 63.

FIG. 5 illustrates an exploded perspective view of a laundry treating apparatus.

Referring to FIG. 5, a configuration of the laundry treating apparatus for thermal insulation of the inner cabinet will be described.

The laundry treating apparatus of the present invention includes a frame 1 having the inner cabinet 3 fixedly secured thereto and an outer cabinet coupled to an outside circumferential surface of the frame.

The outer cabinet can include side cabinet panels 71 on both sides of the inner cabinet, a rear side cabinet panel 73 provided to a rear side of the inner cabinet 3, and a top side cabinet panel 75 provided to a top of the inner cabinet for forming the exterior of the laundry treating apparatus.

The rear side cabinet panel 73 can be provided with a unit portion cabinet panel 733 provided to a rear portion of the supply unit portion 6, and an upper side rear cabinet panel 731 provided to an upper side of the unit portion cabinet panel 733.

Since the user can access to the supply unit portion 6 only by removal of the unit portion cabinet panel 733 in a case the user requires to repair the supply unit portion, the unit portion cabinet panel 733 has an advantage in making maintenance of the supply unit portion easy.

In the meantime, the outer cabinet can include a strength reinforcing portion provided to an inside circumferential surface thereof. The strength reinforcing portion, provided for preventing the strength reinforcing portion from distorting, can be a damping sheet 77 of rubber or the like.

Though FIG. 5 illustrates a case the damping sheet 77 is provided only to the side cabinet panels 71, this does not exclude provision of the damping sheet 77 to rest of the outer cabinet.

The frame 1 includes a body frame 11 provided in a height direction of the inner cabinet 3, side frames 13 provided in both side directions of the inner cabinet 3 for fastening body frames, a rear side frame 15 provided in a rear side direction of the inner cabinet for fastening the body frames, and a front frame 17 provided to support a bottom surface of the inner cabinet 3, and a top frame 19 provided to a top side of the inner cabinet.

FIG. 6 illustrates an exploded perspective view of a coupling structure of the frames, wherein the side frames, the rear side frame, and the front frame have preliminary fastening projections 131, 151, and 171 on both ends thereof, respectively.

In this case, it is preferable that the body frame 11 has preliminary fastening holes 111 provided therein for receiving the preliminary fastening projections.

However, since the preliminary fastening projections 131 and the preliminary fastening holes 111 are configurations for making mounting of the frames easy, the preliminary fastening projections may be provided to the body frame and the preliminary fastening holes may be provided to the side frames, the rear side frame, and the front frame.

Referring to FIG. 5, an air gap forming portion for thermal insulation of the inner cabinet will be described. The air gap forming portion forms an air layer between the inner cabinet 3 and the outer cabinet 7 for thermal insulation of the inner cabinet 3 from an outside of the laundry treating apparatus.

The inner cabinet 3, being a space for progressing sterilization, crumple removal, deodorizing, and so on by using hot air or steam from the supply unit portion 6, is liable to have a poor efficiency of a clothes treatment if the inner cabinet 3 is not thermally insulated from an outside of the inner cabinet.

Even though the inner cabinet can be a foamed mold for thermal insulation, since the foamed mold has problems in that an increased production cost can be caused and weak strength can be caused if a size of the inner cabinet is increased for increasing a clothes holding amount.

Therefore, the air gap forming portion is effective, not only for thermal insulation of the inner cabinet, but also for reduction of a production cost in comparison to a case the inner cabinet is provided by the foamed mold.

And, in a case the inner cabinet is thermally insulated with the air gap forming portion, since the air gap forming portion supports the inner cabinet through the frame 1, the inner cabinet can maintain strength even if a large sized laundry treating apparatus is fabricated.

The air gap forming portion can include side air gaps for spacing a predetermined distance between both sides of the inner cabinet 3 and the side cabinet panels 71 respectively, a rear side air gap for spacing a predetermined distance between the rear side of the inner cabinet and the upper side rear cabinet panel 731, and a top air gap for spacing a predetermined distance between a top side of the inner cabinet and the top side cabinet panel 75.

The side air gap can be provided to the side frame 13 with an air gap frame 811 provided toward a side surface of the inner cabinet 3 (See FIG. 6), the rear side air gap can be an air gap boss 831 projected from the rear side of the inner cabinet 3 toward the rear side frame 15, and the top side air gap can be an air gap bracket 851 provided between the top side of the inner cabinet 3 and the top frame 19.

It is adequate if the air gap boss 831 is provided to be in contact with the rear side cabinet panel 73 or the rear side frame 15. However, it is preferable that the air gap boss 831 is secured to the rear side frame 15, taking not only securing of the inner cabinet, but also formation of the rear side air gap into account.

In the meantime, the top side air gap formed by the air gap bracket 851 has an effect of providing a space for providing a driving unit (the motor, and the power transmission portion) of the moving hanger 4.

That is, since an inside of the inner cabinet 3 is a space having the hot air or the steam flowing therethrough, it is required to prevent the motor 45 or the power transmission portion 47 from rusting. Therefore, if the motor or the power transmission portion is positioned at the top side air gap provided by the air gap bracket 851, the moving hanger 4 can be prevented from becoming to have a poor durability.

In this case, it is preferable that the inner cabinet 3 is provided to include a holder receiving hole 311 for inserting the holder 43 of the moving hanger 4, and a power transmission pass through hole 313 in the top surface.

FIG. 7 illustrates a perspective view of an inner cabinet 3 which is divided into an upper body 31 and a lower body 33.

The inner cabinet 3 is provided dividing the inner cabinet into the upper body and the lower body for easy fabrication of a large sized inner cabinet.

That is, if the inner cabinet is injection molded as one unit without being divided into the upper body and the lower body, the inner cabinet can cause a problem of distortion in a case of the large sized inner cabinet. Therefore, the inner cabinet divided into the upper body and the lower body is effective for solving a problem of distortion.

The upper body 31 includes the holder receiving hole 311, the power transmission portion pass through hole 313 and an upper rib 315 bent to an outside of the inner cabinet from an outside circumferential surface of a lower edge of the upper body and extended therefrom.

The lower body 33 includes the filter unit 337, the first inlet 335, the second inlet 333, and a lower rib 331 extended from an upper side outside circumferential surface of the lower body toward the upper rib 315.

It is preferable that the upper rib 315 is provided to be positioned on an inner side of the inner cabinet more than the lower rib 331, and it is preferable that the upper rib 315 includes a rib receiving portion 3153 for receiving the lower rib 331 for preventing the steam from leaking and improving assembly of the inner cabinet.

In addition, it is preferable that the upper rib 315 further includes a hook 3151 and the lower rib 331 further includes a hook receiving hole 3311 for receiving the hook 3151.

In the meantime, it is preferable that a cover portion 35 is provided on an inner side of the upper rib 315 for covering a coupled surface of the upper body and the lower body and preventing the steam or the hot air from leaking.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundry treating apparatus comprising:

an outer cabinet forming an exterior of the laundry treating apparatus;

an inner cabinet provided within the outer cabinet including a space for holding clothes; and a frame for securing the outer cabinet fixedly to the inner cabinet and supporting an outside circumferential surface of the inner cabinet, the frame including:

a plurality of body frames provided in a height direction of the inner cabinet; and side frames provided to connect the plurality of body frames;

a hanger bar provided in an upper portion of the inner cabinet for hanging the clothes thereon;

a first holder and as second holder for supporting the hanger bar;

a first receiving hole and a second receiving hole located in a top side of the inner cabinet;

a motor located between the top side of the inner cabinet and a top side of the outer cabinet to generate a rotational motion, a power converter configured to convert the rotational motion of the motor into a reciprocating motion of the hanger bar along a width direction of the inner cabinet; and at least one air gap boss projected from a rear side of the inner cabinet toward at least one of the side frames and supported by the at least one of the side frames, the at least one air gap boss forming an air gap between the inner cabinet and the outer cabinet, wherein one end of each holder is located between the top side of the inner cabinet and the top side of the outer cabinet, the other end of each holder is connected with the hanger bar, and wherein the first holder and the second holder are coupled to the hanger bar and coupled to the first receiving hole and the second receiving hole, respectively.

2. The laundry treating apparatus of claim 1, further comprising:

at least one air gap frame projected inward toward the inner cabinet from at least one of the side frames, the at least one air gap frame forming a predetermined air gap between the outer circumferential surface of the inner cabinet and the outer cabinet.

3. The laundry treating apparatus of claim 1, wherein the at least one air gap boss is supported by the at least one side frame of the side frames provided in a rear side direction.

4. The laundry treating apparatus of claim 1, wherein the outer cabinet includes:

side cabinet panels forming both lateral sides of the outer cabinet;

a top side cabinet panel forming the top side of the outer cabinet; and a rear side cabinet panel forming a rear side of the outer cabinet.

5. The laundry treating apparatus of claim 4, wherein the rear side cabinet panel includes:

an upper cabinet panel covering an upper area of the rear side of the outer cabinet; and a lower cabinet panel covering the other area of the rear side of the outer cabinet.

6. The laundry treating apparatus of claim 1, further comprising:

an air supply located below the inner cabinet for supplying air to an inside of the inner cabinet, the air supply including:

an inlet communicating with the inside of the inner cabinet;

an outlet communicating with the inside of the inner cabinet; and a fan making air flow to the outlet; and a steam generator located below the inner cabinet for supplying steam, water, or mist to the inside of the inner cabinet.

7. The laundry treating apparatus of claim 6, wherein the inner cabinet includes:

a first inlet in communication with the outlet of the air supply; and a second inlet in communication with the steam generator, wherein the first inlet and the second inlet are located closer to the rear side of the inner cabinet than to a front side of the inner cabinet.

8. The laundry treating apparatus of claim 1, wherein the first holder and the second holder are configured to respectively support each end of the hanger bar, and wherein the other end of each holder is respectively connected with each end of the hanger bar.

9. The laundry treating apparatus of claim 8, wherein the first holder receiving hole and the second holder receiving hole are arranged along a lateral direction of the inner cabinet, and wherein the first holder and the second holder are inserted into the inner cabinet via the first holder receiving hole and the second holder receiving hole, respectively.

10. The laundry treating apparatus of claim 9, further comprising:

a center hole located at the top side of the inner cabinet, and configured to connect the power converter with the hanger bar through the center hole.

11. The laundry treating apparatus of claim 10, wherein the center hole is located between the first holder receiving hole and the second holder receiving hole.

12. The laundry treating apparatus of claim 1, wherein the at least one air gap boss is arranged in one of at least two columns along the height direction of the inner cabinet.

13. A laundry treating apparatus comprising:

an outer cabinet forming an exterior of the laundry treating apparatus;

an inner cabinet provided within the outer cabinet including a space for holding clothes;

a supply unit portion located below the inner cabinet inside the outer cabinet, and configured to selectively supply air or steam to an inside of the inner cabinet, the supply unit portion including:

an air supply including an inlet communicating with an inside of the inner cabinet, an outlet communicating with the inside of the inner cabinet, and a fan making air flow to the outlet;

a frame for securing the outer cabinet fixedly to the inner cabinet and supporting an outside circumferential surface of the inner cabinet, the frame including:

a plurality of body frames provided in a height direction of the inner cabinet;

side frames provided between the inner cabinet and the outer cabinet to connect the plurality of body frames;

a hanger bar located inside the inner cabinet and configured to have the clothes placed thereon;

a first receiving hole and a second receiving hole located in a top side of the inner cabinet; and at least one air gap boss located between a rear side of the inner cabinet and at least one of the side frames, wherein the at least one air gap boss forms an air gap between the inner cabinet and the outer cabinet, a first holder and a second holder, wherein one end of each holder is located between the top side of the inner cabinet and the top side of the outer cabinet, the other end of each holder is connected with the hanger bar, and wherein the first holder and the second holder are coupled to the hanger bar and coupled to the first receiving hole and the second receiving hole, respectively.

14. The laundry treating apparatus of claim 13, further comprising:

at least one air gap frame projected inward toward the inner cabinet from at least one of the side frames, wherein the at least one air gap frame forms a predetermined air gap between the outer circumferential surface of the inner cabinet and the outer cabinet.

15. The laundry treating apparatus of claim 14, further comprising:

a top frame provided to the top side of the inner cabinet;

an air gap bracket provided between the top side of the inner cabinet and the top frame, wherein the air gap bracket is arranged along a lateral direction of the inner cabinet, and forms a top side air gap having a predetermined distance between the top side of the inner cabinet and the top frame.

16. The laundry treating apparatus of claim 15, wherein the at least one air gap boss is supported by the at least one of the side frames provided in a rear side direction.

17. The laundry treating apparatus of claim 16, wherein the at least one air gap boss is arranged in one of at least two columns along the height direction of the inner cabinet.

18. The laundry treating apparatus of claim 17, wherein the at least one air gap boss engages with the at least one of the side frames provided in the rear side direction.

19. The laundry treating apparatus of claim 13, wherein the hanger bar is arranged along a lateral direction of the inner cabinet.

20. The laundry treating apparatus of claim 19, wherein the first holder and the second holder are configured to respectively support each end of the hanger bar, wherein the other end of each holder is respectively connected with each end of the hanger bar.

21. The laundry treating apparatus of claim 20, wherein the first holder receiving hole and the second holder receiving hole are arranged along the lateral direction of the inner cabinet, and wherein the first holder and the second holder are inserted into the inner cabinet via the first receiving hole and the second receiving hole, respectively.

22. The laundry treating apparatus of claim 21, further comprising:

a motor located between the top side of the inner cabinet and a top side of the outer cabinet to generate a rotational motion; and a power converter connected with the hanger bar, and configured to convert the rotational motion of the motor into a reciprocating motion of the hanger bar along the lateral direction of the inner cabinet.

23. The laundry treating apparatus of claim 22, further comprising:

a center hole located at the top side of the inner cabinet, and configured to connect the power converter with the hanger bar through the center hole.

24. The laundry treating apparatus of claim 23, wherein the center hole is located between the first holder receiving hole and the second holder receiving hole.

25. The laundry treating apparatus of claim 13, wherein of the outer cabinet includes an upper side rear cabinet panel covering an upper area of a rear side of the outer cabinet, and a unit portion cabinet panel covering an other area of the rear side of the outer cabinet.

26. The laundry treating apparatus of claim 25, wherein the air supply is located below the inner cabinet, and wherein the air supply is exposed to a user based on opening of the unit portion cabinet panel.

27. The laundry treating apparatus of claim 13, wherein the at least one air gap boss engages with the at least one of the side frames provided in a rear side direction.

28. The laundry treating apparatus of claim 13, wherein the at least one air gap boss is projected from the rear side of the inner cabinet toward the at least one of the side frames provided in the rear side direction.

* * * * *